United States Patent [19]

Güell

[11] Patent Number: 5,070,709

[45] Date of Patent: Dec. 10, 1991

[54] STRIPING SYSTEM FOR CIRCULAR KNITTING MACHINE

[75] Inventor: Jose M. D. Güell, Barcelona, Spain

[73] Assignee: Jumberca, S. A., Barcelona, Spain

[21] Appl. No.: 614,024

[22] Filed: Nov. 16, 1990

Related U.S. Application Data

[63] Continuation of Ser. No. 279,070, Dec. 2, 1988, abandoned.

[30] Foreign Application Priority Data

Dec. 4, 1987 [ES] Spain ..... 8703484

[51] Int. Cl.[5] ..... D04B 15/60

[52] U.S. Cl. ..... 60/140 R

[58] Field of Search ..... 66/138, 139, 140 R

[56] References Cited

U.S. PATENT DOCUMENTS 4,656,842 4/1987 Sawazaki ..... 66/139

FOREIGN PATENT DOCUMENTS 2805779 8/1978 Fed. Rep. of Germany .... 66/140 R 481545 7/1980 Spain ..... 66/140 R

*Primary Examiner*—Wm. Carter Reynolds

*Attorney, Agent, or Firm*—Staas & Halsey

[57] ABSTRACT

The striper of the system is provided with yarnguide rods which are pivotable to a position conductive to delivery of yarn to the needle. The rod to be pivoted is selected by a selector which imposes a small movement on a slide member and this small movement causes the slide mmber to be moved by a first radial cam such that its movement causes pivotint of the rod. Independently of said pivoting, a closing lever and an opening lever respectively adapted to retain and cut the yarn or release it are always moved. The movement of said levers, is only effective when at least one yarnguide rod has pivoted. There is a striper for each cam section and all of them are controlled by a single selection box containing the selectors.

6 Claims, 13 Drawing Sheets

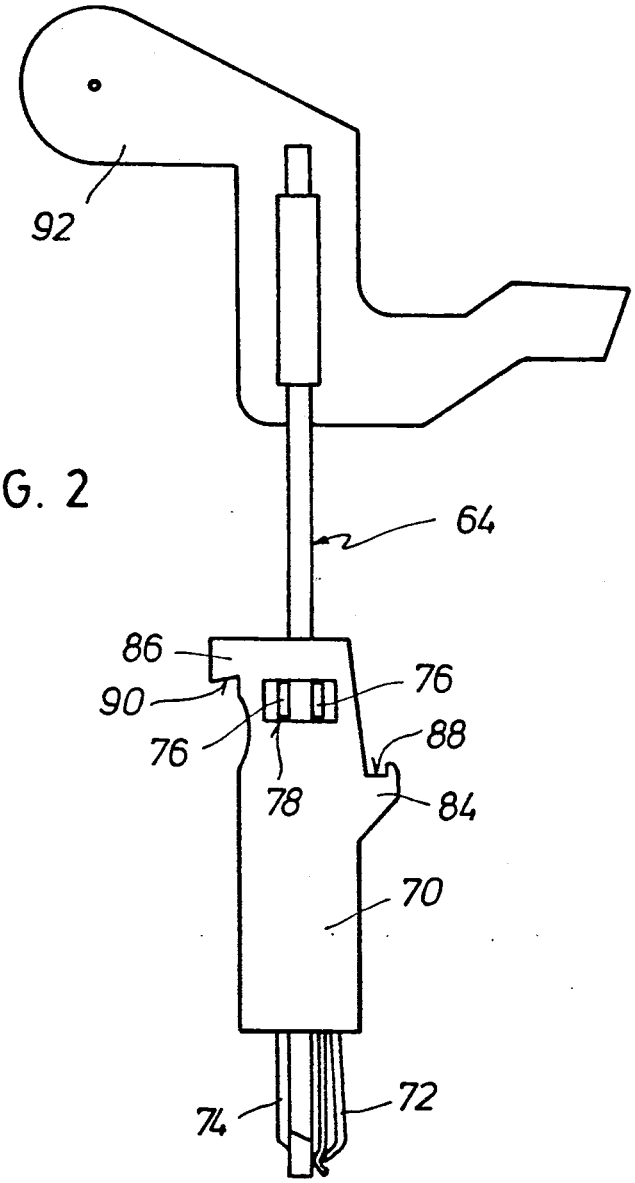
FIG. 2
FIG. 3
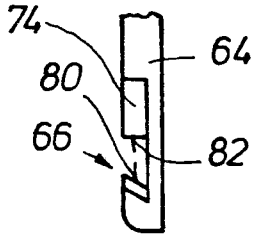

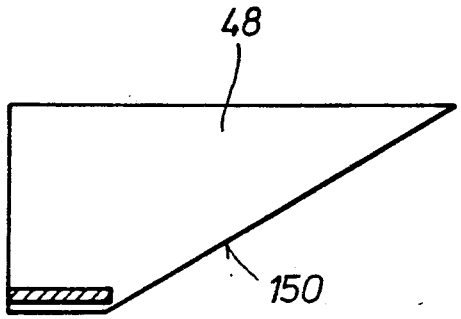
FIG. 12
FIG. 11
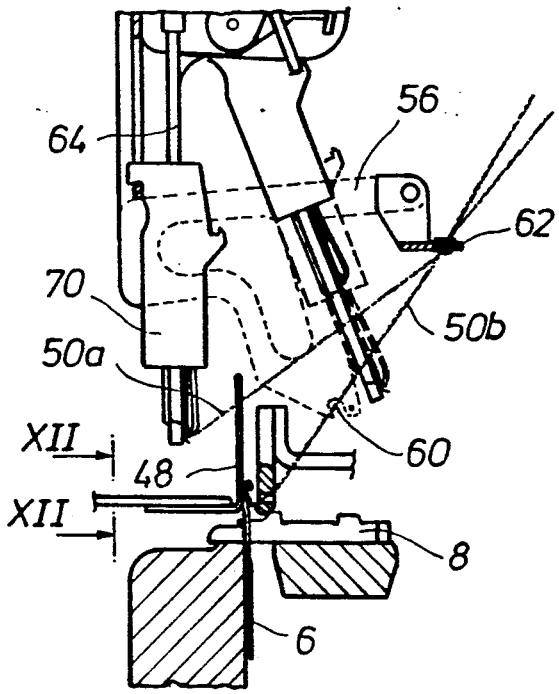

STRIPING SYSTEM FOR CIRCULAR KNITTING MACHINE

This is a continuation of copending application Ser. No. 07/279,070 filed on Dec. 2, 1988, now abandoned.

BACKGROUND OF THE INVENTION

1. Field of the Invention

The invention relates to a striping system for a circular knitting machine, the machine comprising an axis of rotation, a needle cylinder provided with needles adapted to receive knitting yarn, cam sections for regulating the movement of said needles, a support for said cam sections, stripers and a common yarnguide from which the yarn may run to the needle.

2. Description of the Related Art

In known systems, stripers are used allowing the pattern it is desired to knit to be programmed without taking the pattern that was being knitted into account. This leads to the frequent error of programming the coming into operation of a moving yarnguide rod which was already in operation.

This error causes serious problems in the conventional stripers, since the movement of the moving yarnguide rod readily drags the yarn that was being knitted out of the correct place, thus causing the needles to miss it.

Furthermore, in the usual systems there is an extraordinarily short period of time in which to give the necessary commands to the striper and for the latter to execute them. This factor, on the one hand, limits the possibilities of the striper and, on the other hand, subjects the striper components to very heavy mechanical stresses which are obviously required to operate at the required speed. Thus, the risk of breakdown is high.

It should also be noted that the conventional systems require the striper to be subjected to three selections: one for the yarnguide which has to come into operation; another for freeing the incoming yarn and a third one for cutting the outgoing yarn. All this creates a complex situation.

SUMMARY OF THE INVENTION

It is an object of the invention to provide a reliable, safe system in which the aforementioned drawbacks are overcome.

The above object is achieved by a system of the type described hereinbefore and which comprises:

at least two yarnguide rods, each being provided with a yarn notch, each rod being capable of pivoting between a first position away from said axis of rotation and a second position towards said axis of rotation;

a first spring for each yarnguide rod urging it to said first position;

a support member associated with each yarnguide rod and fixedly attached to a gripper member for retaining the yarn and with a shears member for cutting said yarn, said support member being provided with first means to be pushed downwardly and second means to be pushed upwardly, and being adapted to slide along the rod between a first lower position in which the gripper member retains the yarn and a second upper position in which the gripper member does not retain the yarn, said shears member being adapted to cut the yarn on moving from said second to said first position;

a guide plate for each yarnguide rod, provided with a lower contour in which there is provided a recess for guiding the yarn between the infeed yarnguide and the common yarnguide;

a moving cam, adapted to pick up the yarn retained in a yarnguide rod when the latter is in said second position thereof, such that the yarn slides along said lower contour to reach said recess, to be inserted in the common yarnguide and to be captured by the needle;

a pivoting mechanism for pivoting each yarnguide rod comprising a last rocking lever having an end;

a selection device for actuating the pivoting mechanisms;

a closing mechanism to lead said support member to said first lower position; and an opening mechanism to lead said support member to said second upper position.

According to a further feature of the invention, said selection device comprises:

a slide member for each pivoting mechanism, which is adapted to slide between a retracted position and an extended position, which is housed in a slot and is provided with: a tail portion capable of being depressed into the slot against the urging of a second spring; a rear engagement surface; an upper engagement surface; a front engagement surface; an upper butt and a recess in which there is inserted said end of said last rocking lever with a clearance therebetween, such that a sliding movement of the slide member from said retracted position of a magnitude greater than said clearance, causes said last rocking lever to rock and the actuation of said pivoting mechanism;

a single selection box which, for each slide member, comprises a selector adapted to occupy a retracted inoperative position or an extended operative position in which it engages said upper butt, causing the slide member to slide over a first distance of a magnitude of the order of said clearance;

a first axial cam engaging said upper engagement surfaces of said slide members, causing the depression of said tail portion when the slide members have not moved over said first distance;

a first radial cam engaging said rear engagement surfaces when said tail portions have not been depressed; and a second radial cam engaging said front engagement surfaces to return the slide members to said retracted position.

In one development of the invention said closing mechanism is provided with a first rocking arm pivotably connected to a closing lever which, on the one hand, is adapted to slide between a first retracted position to which it is urged by a third spring and a second, extended position and, on the other hand it is also adapted to pivot between an inoperative position, to which it is urged by a fourth spring, and an operative position to which it is led by the pivoting of any yarnguide rod to the second position thereof towards said axis of rotation, said closing lever having a terminal edge which, when the closing lever has been pivoted to the operative position thereof and is slid towards the extended position thereof, engages said first means of said support member, leading it to a first lower position thereof.

The invention also contemplates that said opening mechanism be provided with a second rocking arm pivotably attached to an opening lever which is adapted to slide between a low position to which it is urged by a fifth spring and a high position, said opening lever having an inner operative edge which, when the lever slides from said low position to said high position, is adapted to engage said second means of said support member, when the yarnguide rod corresponding to the support member is in the second position thereof towards the axis of rotation.

BRIEF DESCRIPTION OF THE DRAWINGS

Further advantages and features of the invention will be appreciated in the following description in which, without any limiting intention, there is described a preferred embodiment of the invention, with reference to the accompanying drawings. In the drawings:

FIG. 2 is a side elevation view, on a larger scale, of a yarnguide rod attached to a corresponding lever.

FIG. 3 is a front view of the lower end of the yarnguide rod, the shears member being illustrated in part and the gripper member having been deleted for greater clarity.

FIG. 11(*a*) is a perspective view showing the parts of the striping mechanism 2 shown in FIG. 11, with the needle cylinder and common yarnguide removed for clarity.

FIG. 12 is a cross section view on the line XII—XII of FIG. 11, limited to the moving cam.

DETAILED DESCRIPTION OF THE PREFERRED EMBODIMENTS

Figure 1:
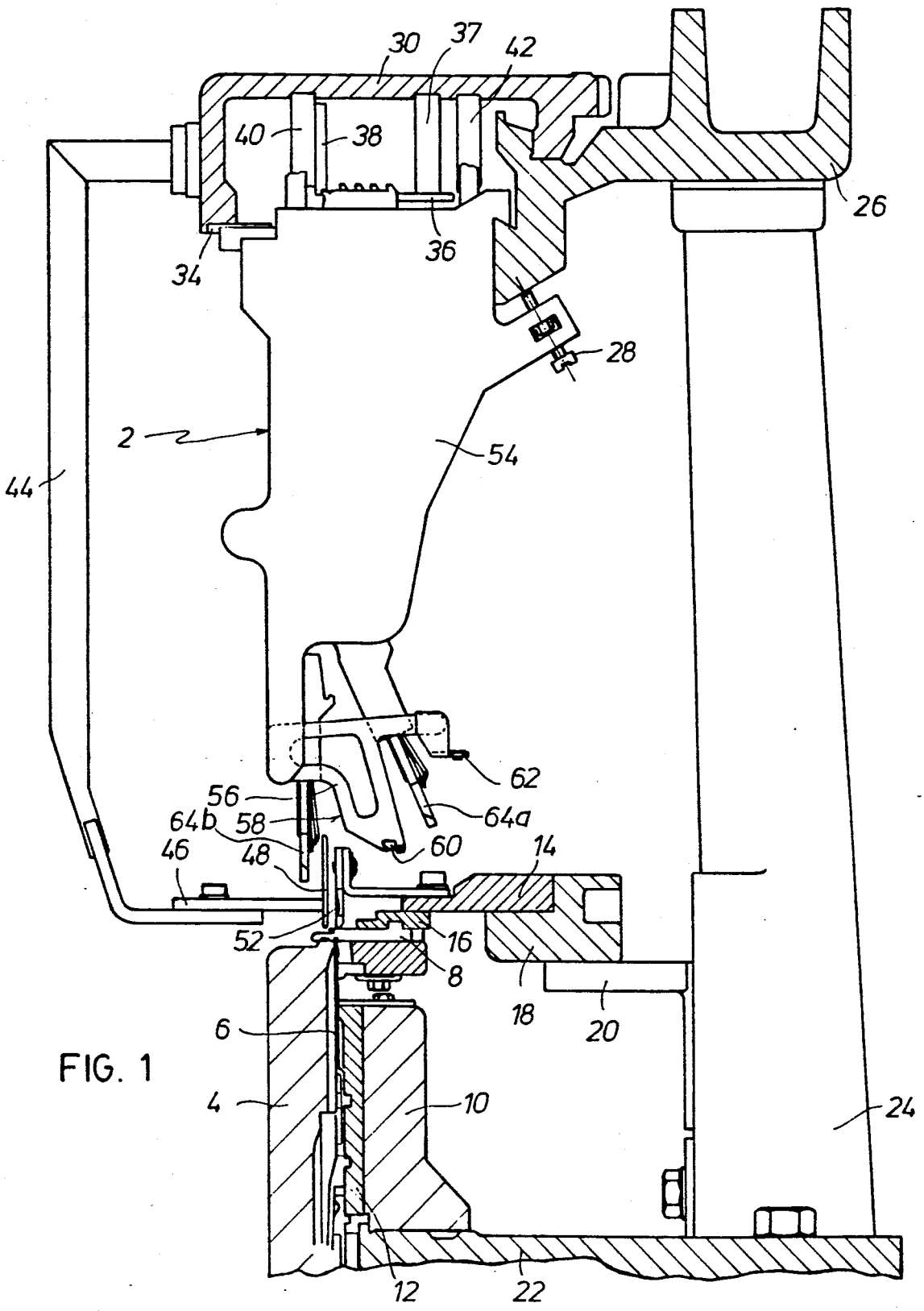
FIG. 1 is an elevation view of the system of the invention, mounted on a circular knitting machine shown in part.

In the general view of FIG. 1, striper 2 is mounted on a circular knitting machine. A large part of the members forming the yarn changeover system are contained in the striper 2 and detailed reference will be made to said members hereinafter.

The needle cylinder 4 is illustrated at the bottom of the Figure and is seen to be provided with grooves housing needles 6 and other items, a description of which is not necessary for an understanding of the invention. Sinkers 8 cooperate with said needles and the cam sections 10 and cams 12, for the needles. The cam sections 14 and cams 16 for the sinkers 8 are also shown.

The cam sections 14 are supported on a support 18, mounted in turn on brackets 20. The cam sections 10 are held by a support 22, serving as a base for columns 24 which in turn support the said brackets 20.

At the upper end thereof, the columns 24 support a ring 26 to which the stripers 2 are attached by bolts 28, taking advantage of an appropriate configuration of the ring 26 and the stripers. On the ring 26 there is mounted a rotating ring 30 driven by the kinematic chain (not illustrated) of the machine for rotation around an axis of rotation (not shown either and which would be situated to the left of FIG. 1), at the same speed as the needle cylinder 4.

Figure 8:
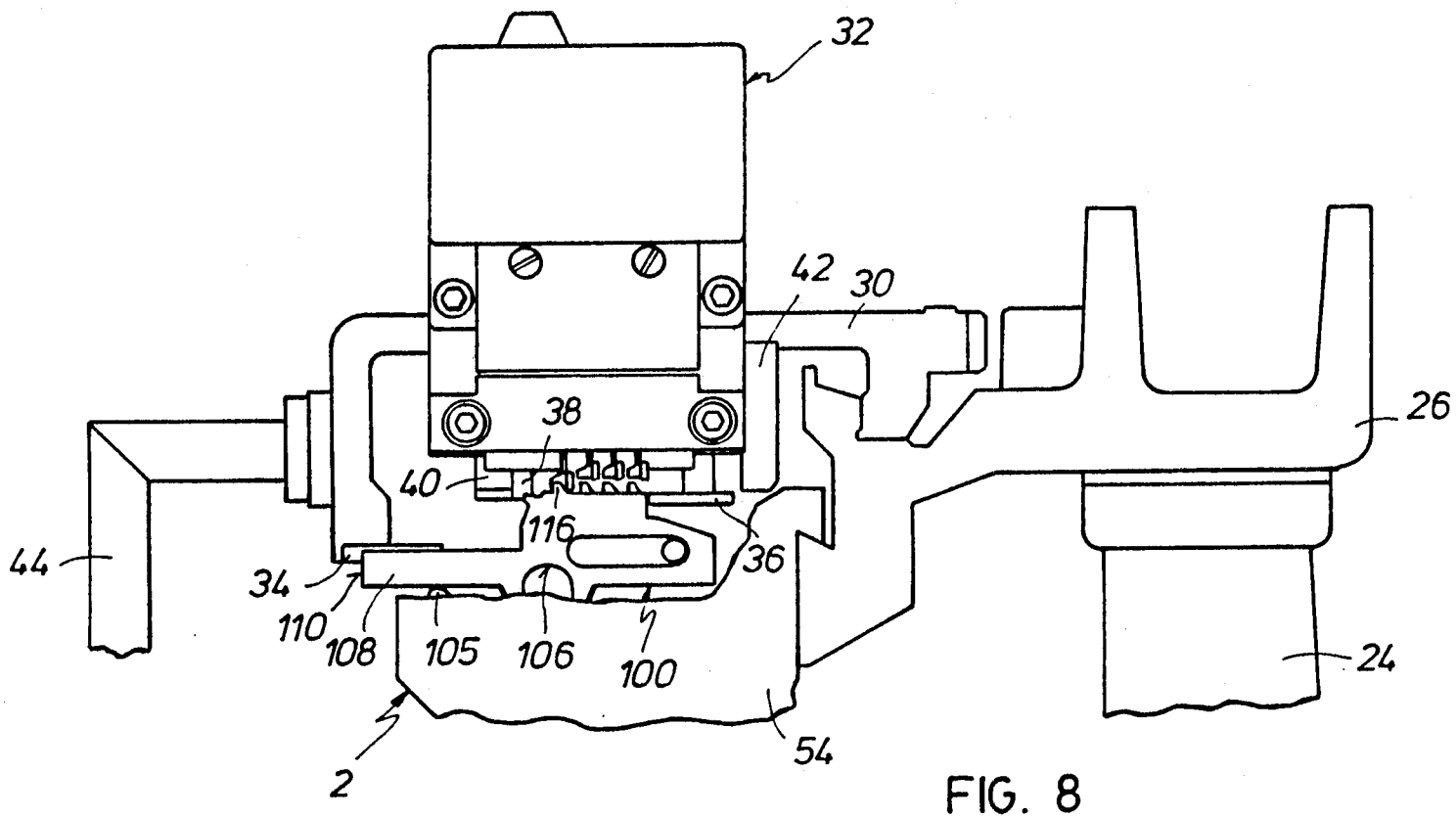
FIG. 8 is an elevation view of the top portion of the striper associated with the selection box and other system parts, the rigid front cover of the frame being shown partly cut away.

A selection box 32 (FIG. 8), to be referred to hereinafter, is mounted on the ring 30. The ring 30 also supports a first radial cam 34 and a second radial cam 36, as well as three axial cams 38, 40 and 42. The second radial cam 36 is supported by an intermediate support ring 37.

Herein the term "radial" is used to designate the cams whose operative surface is arcuate and is held generally parallel to the machine axis of rotation. Likewise, the axial cams are those whose operative surface is the lower surface of the cam and which, therefore, is oriented generally normal to said axis of rotation, although such surface may be curved.

The ring 30 draws along a support arm 44 for holding a support 46 on which a moving cam 48 is mounted in association with the needle removal area of the striping machines. The purpose of the moving cam, as discussed herein after, is to take the yarn offered by the stripers to be changed and place it within a common yarnguide 52 to be captured by the needles 6.

Each striper 2 is provided preferably with two parallel rigid covers 54 (of which only the front one is seen in FIG. 1). A plurality of shafts for the elements of the different mechanisms are located between the covers. Attached to the striper are guide plates 56 having a lower contour 58 wherein there is located a recess 60 for guiding the yarn extending between the needle and the infeed yarnguides 62.

Yarnguide rods 64, of which there are at least two, are very important for the system. Each yarnguide rod 64 (FIGS. 2 and 3) is provided with a generally hook shaped notch 66 and the rods are pivotable between a first position 64*a* away from the axis of rotation of the machine and a position 64*b* towards said axis (FIG. 1), there being a first spring 68 (FIGS. 4 and 5) urging the corresponding rod 64 to said first position. Each rod 64 is located between two guide plates 56.

Each yarnguide rod 64 is associated with a support member 70 which, in turn is attached to a gripper member 72 for retaining the yarn and a shears member 74 for cutting the yarn. The attachment may be effected, for example, by tabs 76 on each of said members extending through a window 78 of the support member 70.

Figure 4:
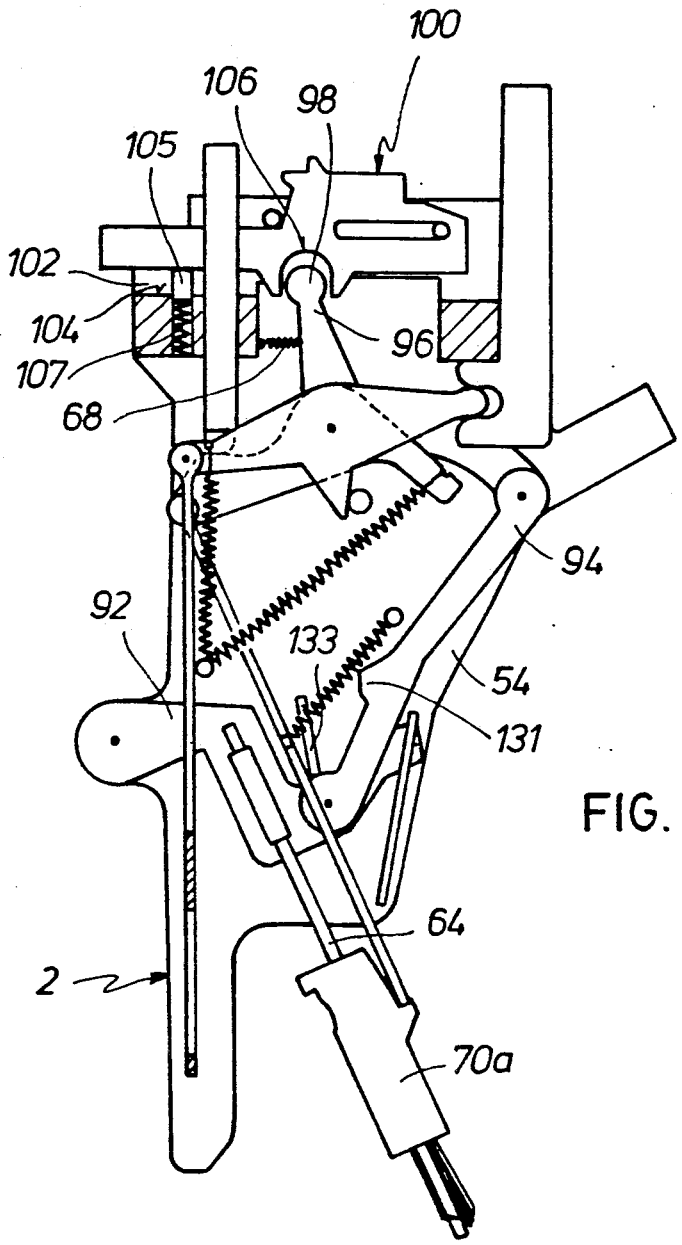
FIG. 4 is a partial elevation view of the striper, without a frame cover, showing a yarnguide rod pivoted to the first position thereof away from the axis of rotation; the remaining yarnguide rods have been omitted for clarity, although at least one of them is in a second position thereof towards the axis of rotation, in view of the position of the closing lever.
Figure 5:
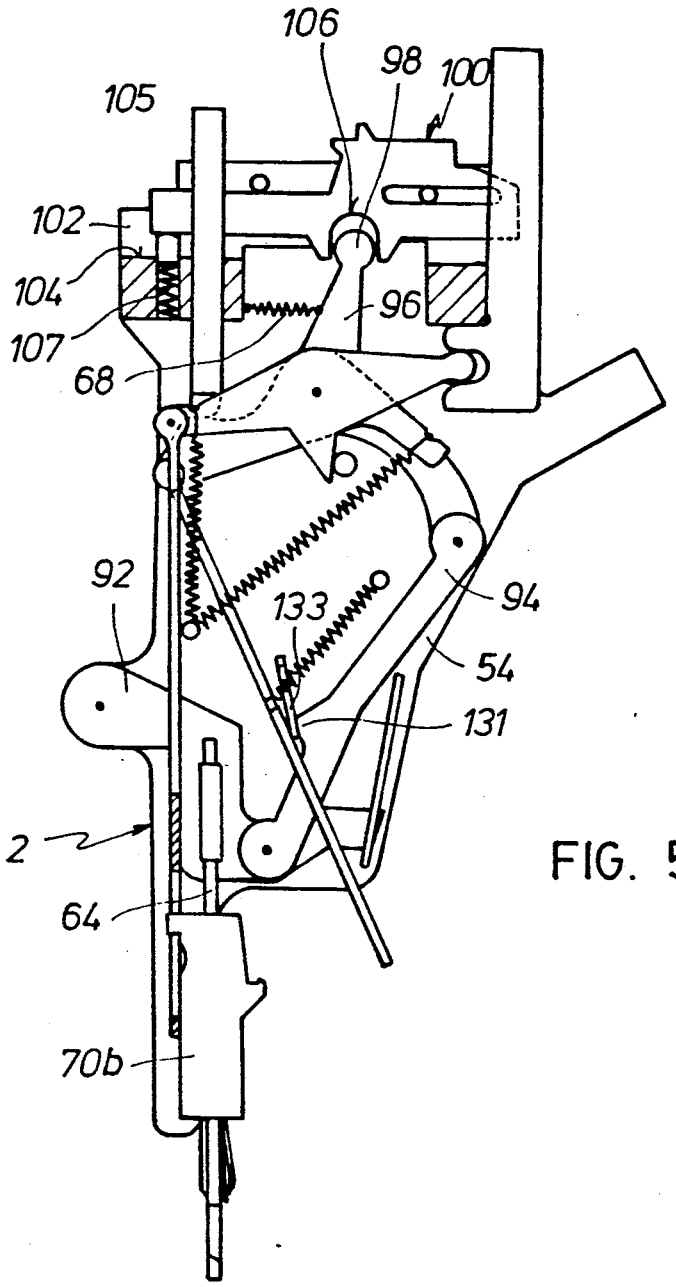
FIG. 5 is a similar view to the previous one, with the yarnguide rod pivoted to the second position thereof towards the axis of rotation.

The support member 70, together with the members 72 and 74, is adapted to slide along the rod (to which it is snugly mounted) between a first lower position (70*a* in FIG. 4) and a second upper position (70*b* in FIG. 5). In said first position the gripper member 72 retains the yarn against the rod body 64 and in the second upper position the yarn is freed from the gripper member.

The notch 66 is provided with an edge 80 which, together with the lower edge 82 of the shears member cut the yarn when the support member 70, together with the shears member 74 moves from said second position to said first position.

Each support member 70 is provided with first means for being pushed downwards towards said first position and second means for being pushed upwardly towards said second position. In a simple embodiment, these first and second means may be formed by respective fins 84 and 86 respectively having an upper transverse surface 88 and a lower transverse surface 90.

Each yarnguide rod 64 is attached to a lever 92 pivotably connected to another lever 94 and the latter in turn is attached to a last rocking lever 96 which has an end 98.

At the top of the striper 2 there is a slide member 100 for each yarnguide rod 64. Each slide member 100 is housed in a slot 102 with a space normally existing between the slide member 100 and the bottom 104 of the slot, due to the existence of the pushbutton 105 and the spring 107. Preferably, there is another button and another spring (not shown) which engage the lower front portion of the slide member, whereby the slide member is adaptably moveable relative to the selector and the cams to be described hereinafter. The slide member 100 is adapted to slide between a retracted position (FIG. 4) and an extended position (FIG. 5). Later on, a third or initial position is described.

To the extent that each slide member 100 is connected to a pivoting mechanism for the yarnguide rods 64, it should be said here that the slide member is provided with a recess 106 in which said end 98 is inserted with a clearance therebetween. As a result of said clearance, any sliding movement of the slide member of a magnitude inferior to that of the clearance does not cause the slide member 100 to engage said end 98 and, therefore, the last lever 96 does not rock.

When said sliding movement is greater than said clearance, the last lever 96 is caused to rock, thereby moving the lever 94 and, therewith, the lever 92. The last named is connected to the corresponding yarnguide rod 64, whereby a sliding movement of the slide member 100 from the retracted position thereof to the extended position thereof causes the yarnguide rod 64 to pivot from the first position 70*a* to the second position 70*b* thereof. Obviously, an opposite sliding movement of the slide member 100 causes the rod 64 to pivot in the opposite direction, i.e. from the second position 70*b* to the first position 70*a* thereof.

For greater clarity, reference has been made in FIGS. 4 and 5 only to the items involved in the rod pivoting mechanism.

Figure 6:
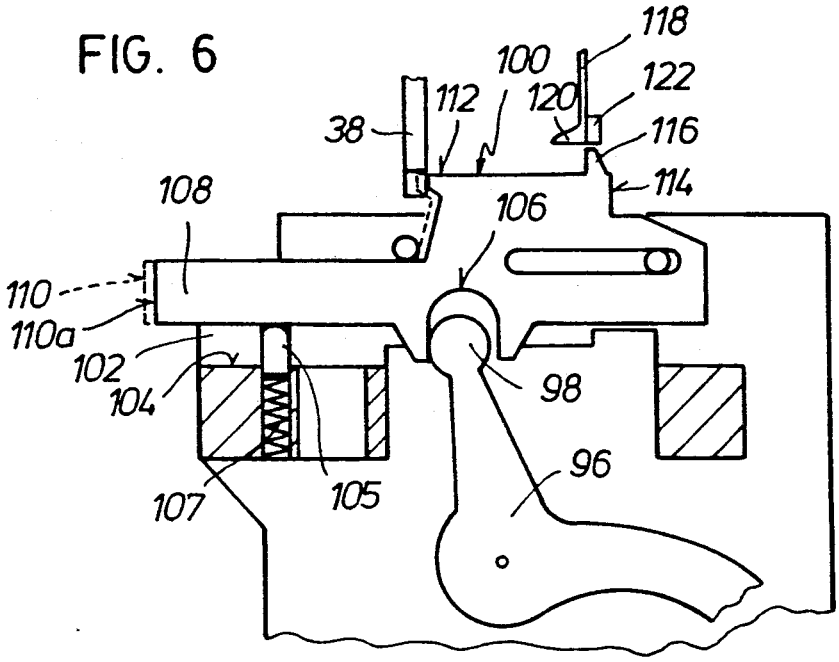
FIG. 6 is a schematic view of the slide member, associated with the last rocking lever of the pivoting mechanism.
Figure 7:
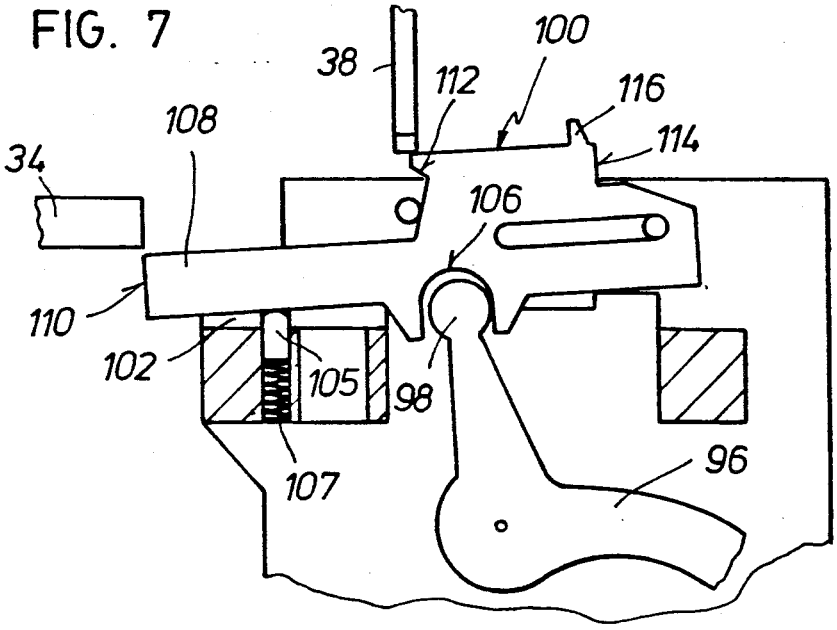
FIG. 7 is a similar view to the previous one, showing a further position of the slide member.

The slide member 100 is seen (FIGS. 6, 7 and 8) to have furthermore a tail portion 108 capable of being depressed to the bottom 104 of the slot 102, against the force of the second spring 107. Likewise, there is a rear engagement surface 110, an upper engagement surface 112 and a front engagement surface 114. Furthermore, each slide member 100 is provided with an upper butt 116; the position of the upper butt 116 of a slide member 100 is advanced or in arrears relative to the upper butts of the possibly contiguous slide members, so that each upper butt 116 associates itself with each of the selectors 118 of the selected box 32, such that the respective butts 116 of the different slide members are mutually offset.

There is, furthermore, a single selection box 32 provided with as many selectors 118 as there are butts 116, i.e. as slide members 100 and the selectors are correspondingly offset with the butts 116.

Said selectors 118, as has already been disclosed in other patents and patent applications of the applicant, may be in an inoperative retracted position or an operative extended position. They are provided with a sloping surface 120 which engages the corresponding butt 116, when the selector is in the operative position and, with little effort, the butt 116 may be caused to advance over a first distance (portion between initial position 110 and retracted position 110*a* in FIG. 6), equivalent to the clearance between the end 98 and recess 106. The continued forward movement of the selector 118 places the butt 116 in front of the head 122 of the selector, whereby it is led to its inoperative position, in which it remains or not, depending on whether programmable magnetic elements are excited or not.

In accordance with the foregoing, the selection of the pivoting movement of the yarnguide rods 64 is easy to understand.

When selection occurs, i.e. when a yarnguide rod has to pivot, the corresponding selector 118 moves to the operative position thereof and engages the upper butt 116 of the slide member 100. Thereupon, the slide member 100 moves away from the initial position thereof and slides over the said first distance and thus the upper engagement surface 112 is taken out of the reach of the first axial cam 38. Consequently, the tail portion 108 is not depressed in the slot, whereby the rear surface (in position 110*a*) is engaged by the first radial cam 34 and the slide member is pushed towards its extended position, whereby the recess 106 thereof engages the end 98 of the last rocking lever 96, the levers 92 and 94 are moved and the yarnguide rod 64 pivots. Thereafter, the second radial cam 36 engages the front engagement surface 114 and returns the slide member 100 to its initial position in which the rear surface is in position 110 of FIG. 6.

When no selection occurs, i.e. a yarnguide rod 64 is not to pivot, the corresponding selector 118 remains in the inoperative position thereof. Consequently, the upper engagement surface 112 (FIG. 7) is not taken out of the reach of the first axial cam 38, whereby this pushes the slide member 100 and the tail portion 108 is depressed in the slot 102. In this case, it is the rear engagement surface 110 which is taken out of the reach of the first radial cam 34, thus the slide member does not slide and the corresponding yarnguide rod does not pivot. After the engagement with the first radial cam 38 is terminated, the second spring 107 returns the slide member to its initial retracted position and thus it is ready for selection or otherwise on a future occasion.

The system is also provided with a closing mechanism to take said support member 70 to the said first lower position.

Figure 9:
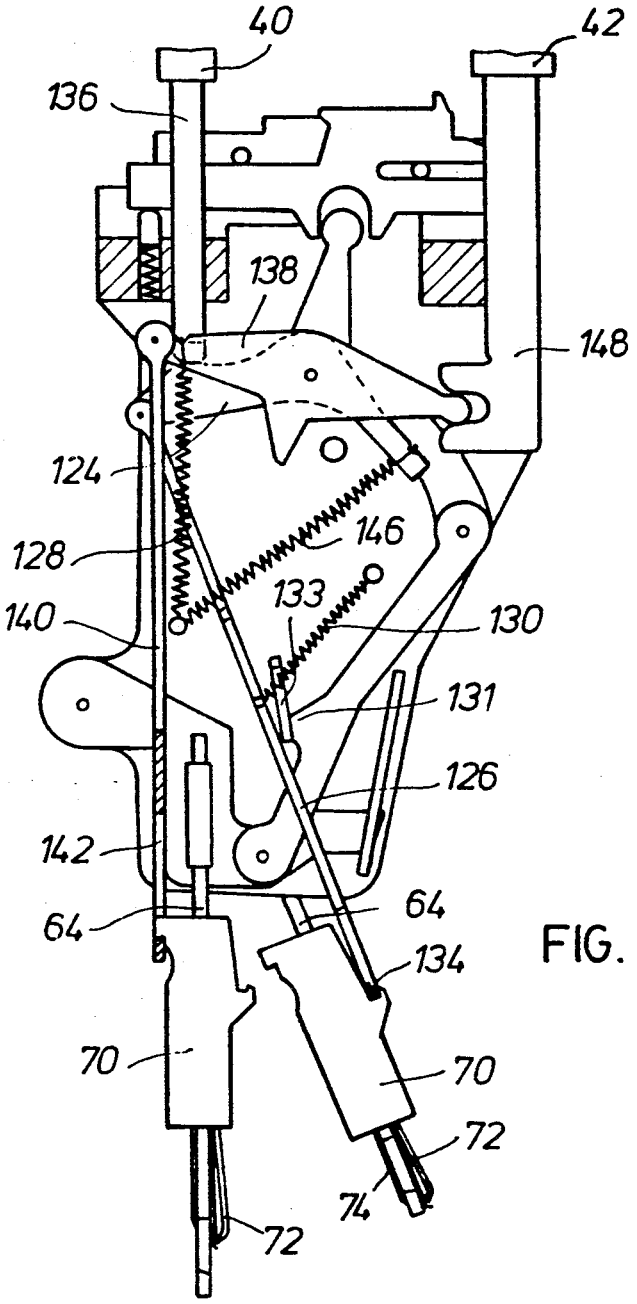
FIG. 9 is a part elevation view of the striper, showing a yarnguide rod in the first pivoting position thereof and with the support member in the second upper position thereof and another yarnguide rod in the second pivoting position thereof and with the support member in the first lower position thereof; only one last rocking lever has been shown.
Figure 10:
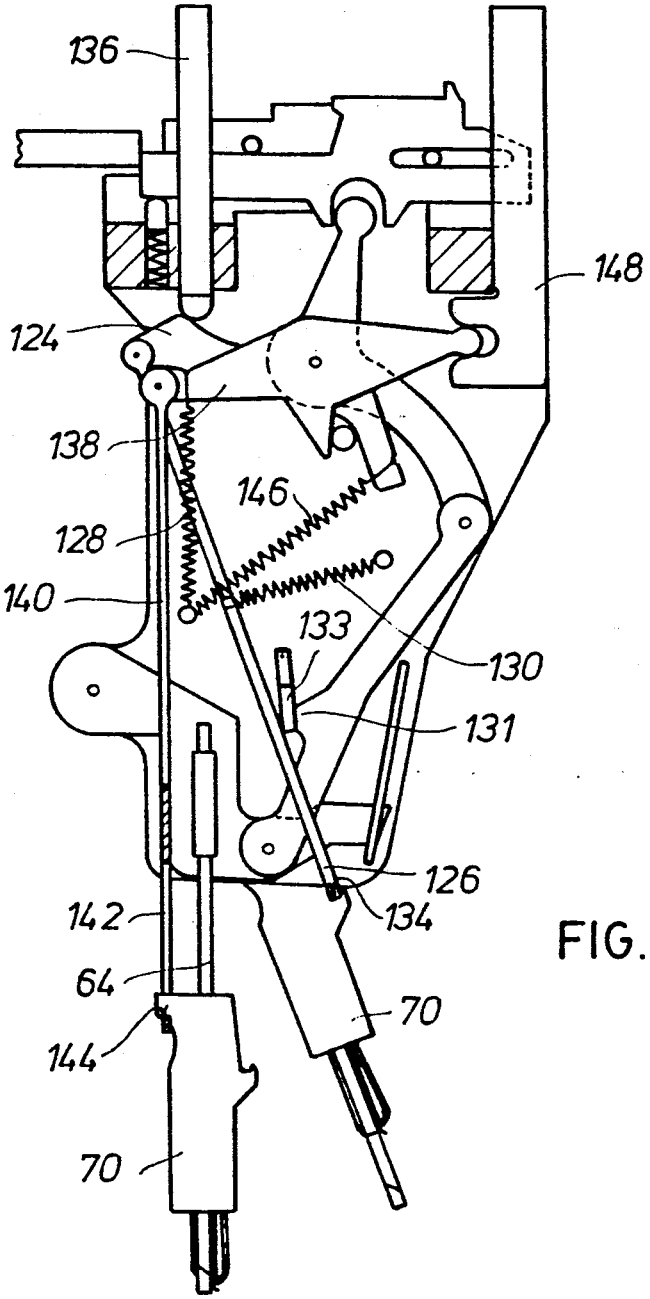
FIG. 10 is a similar view to the previous one, with the lower and upper positions of the support members being reversed.

Said closing mechanism comprises a first rocking arm 124 pivotably connected to a closing lever 126. The lever 126 may move in two ways: in the first place, it is adapted to slide from a first retracted position, shown in FIG. 10, to a second extended position shown in FIG. 9. A third spring 146 engages the arm 124 and urges the closing lever to the first retracted position.

Secondly, the closing lever 126 may pivot between an operative position and a not shown inoperative position.

Figure 15:
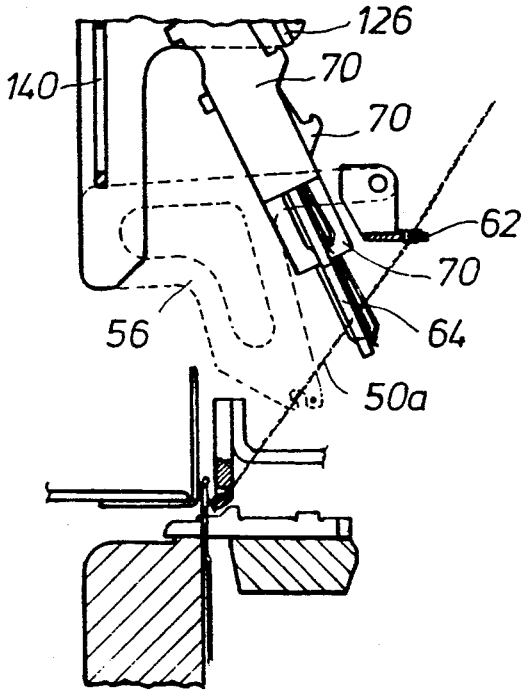

A fourth spring 130 urges the lever to the said inoperative position, in which on sliding it does not engage the support member 70. This situation is illustrated in FIG. 15, where the lower end of the lever 126 is seen to be orientated in a plane not containing the fin of the support member 70. The lever 126 is moved to the operative position when any yarnguide rod is pivoted to its second position towards the axis of rotation. This movement is caused by the neb 131 of the lever 94. When the yarnguide rods 64 are in the first position thereof away from the axis (FIG. 4), the corresponding neb 131 is separated from a swinging arm 133. On the contrary, when one of the rods 64 is in the first position thereof towards to the axis (FIGS. 9 and 10), the corresponding neb 131 of lever 94 engages the swinging arm 133 which, in turn, pushes the closing lever 126 to the operative position thereof.

The closing lever 126 has an edge 134 which, when the lever 126 is in the said operative position and is slid towards its second extended position, engages said first means, i.e. the upper transverse surface 88, of the support member 70. Thus said support member is moved to the lower position thereof (FIG. 9) whereby, obviously, the gripper member and the shears member are also lowered; the former retains any yarn on the rod 64 and the latter cuts it, as stated hereinbefore. The closing lever 126 is moved from the first retracted position to the second extended position by a first pusher 136 which, in turn, is moved by the second axial cam 40.

An opening mechanism is now described. This is provided with a second rocking arm 138 also pivotably connected to an opening lever 140 having a window 142 with an active inner edge 144.

The lever 140 may move between a high position (FIG. 9) and a low position (FIG. 10) to which it is urged by a fifth spring 128 engaging the second rocking arm 138.

When a yarnguide rod 64 is towards the axis of rotation, the sliding of the opening lever 140 to its high position causes the active inner edge 144 to engage the lower transverse surface 90 of the fin 86, whereby the support member 70 rises, together with a gripper member 72, which thus releases any retained yarn.

Figure 11A:
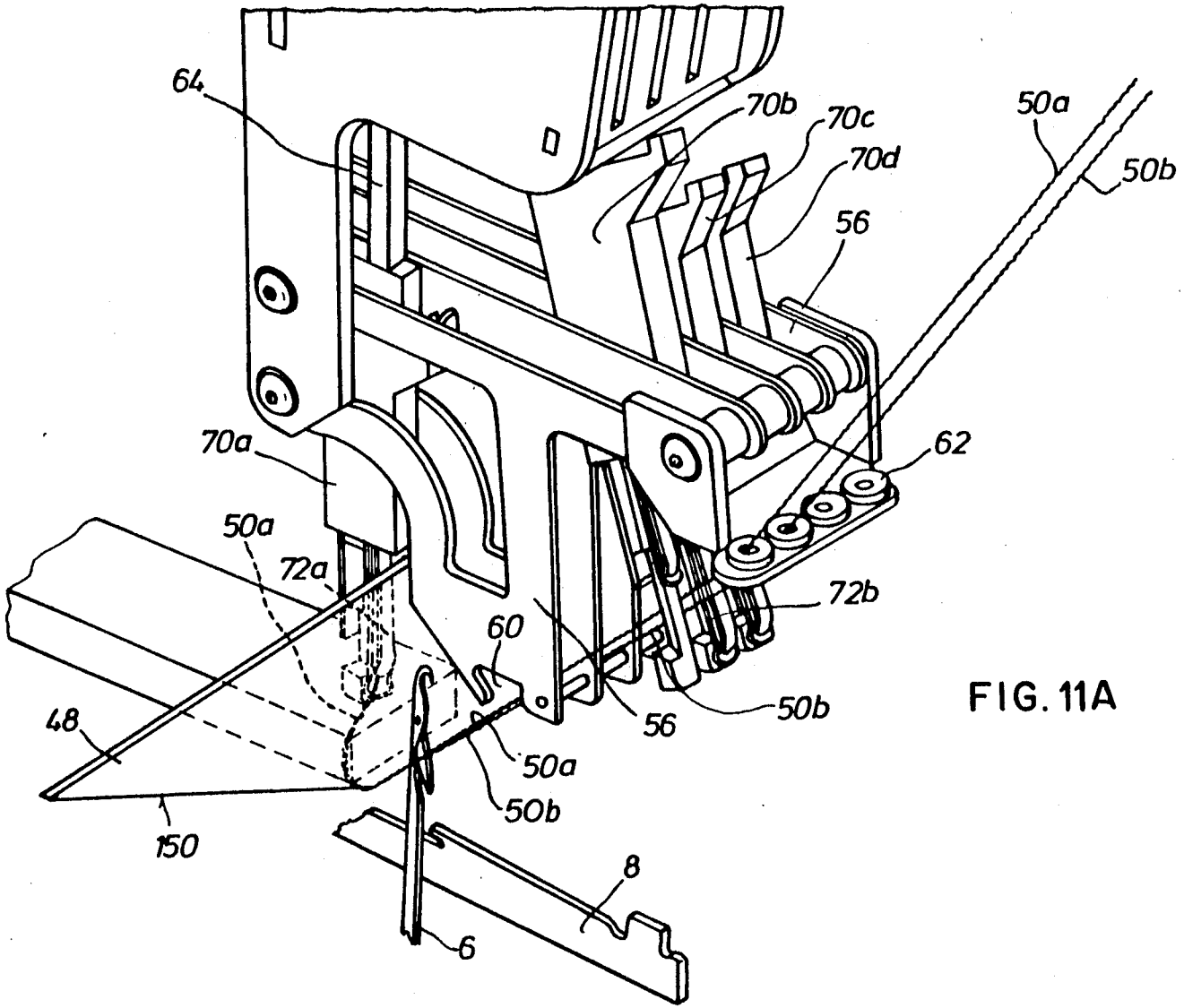
FIG. 11 is an elevation view of the lower portion of the striper in an operative stage thereof; the guide plate has been drawn in phantom lines for clarity.

In FIG. 11(*a*), 50(*a*) designates the yarn being introduced, which is being offered to the needles 6. The support members 70(*a*) (corresponding to the yarn 50(*a*)) has been displaced towards the center of the machine (to the left in the figure). In this position, it still holds the yarn 50(*a*) gripped, since the gripper 72(*a*) is in the low position. The moving cam has placed the yarn 50(*a*) in the path of the needles and the needle shown is taking it. Thereafter, the cam synchronism operates and the opening lever 140 (FIG. 9) drives the support member upwards, thereby releasing the yarn 50(*a*). Therefore, the incoming yarn 50(*a*) and the outgoing yarn 50(*b*) are knit simultaneously by a small number of needles (approximately from six to ten). Thereafter, the closing lever 126 acts on the support member 70(*b*), whereby the gripper 72(*b*) is lowered from the position shown, cutting the outgoing yarn 50(*b*) and leaving it gripped. The support member 70(*a*) then rocks towards the right of the figure keeping the corresponding gripper 72(*a*) open and this will not close again until a further change takes place. The support members 70(*c*) and 70(*d*) are closed, keeping the yarns not taking part in the change gripped.

The sliding of the opening lever 140 is controlled by a second pusher 148 engaged by the third axial cam.

Figure 13:
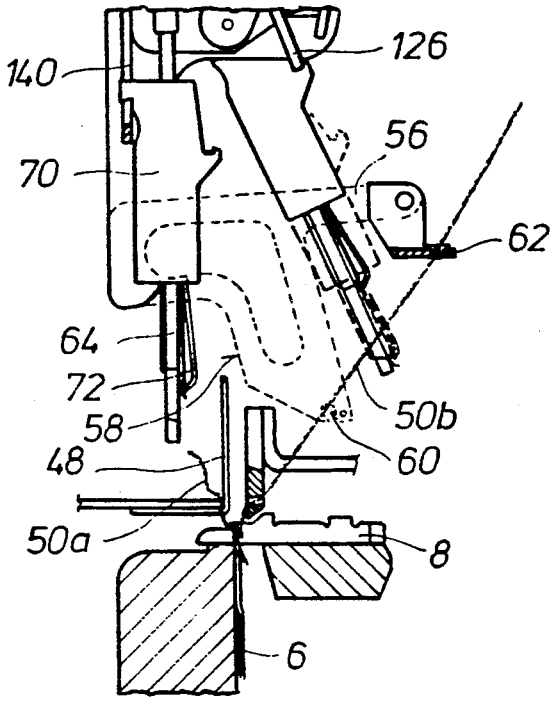
FIGS. 13 to 15 are similar views to FIG. 11, showing other operative stages of the striper.

With regard to the delivery of the yarn 50, the operation is as follows. The yarnguide rod 64 containing the yarn 50*a* to be knitted is pivoted to the second position thereof towards the axis of rotation (FIG. 11). Thus the yarn 50*a* is placed within the reach of the moving cam 48 and the yarn 50*a* slides over the contour 150 of the cam 48 and from there to the lower contour 58 of the corresponding guide plate 56 until it is inserted in the recess 60. The moving cam 48 continues drawing the yarn until it is inserted in the common yarnguide 52, being extended between the latter and the infeed yarnguide 62, whereby the yarn has been removed from the yarnguide rod 64. In this position it lies within the range of movement of the head of the needles 6, whereby the latter capture the yarn 50*a* and start to knit it with the yarn 50*b* which was already being knitted. The yarns 50*a* and 50*b* are partly superimposed in FIG. 13.

Figure 14:
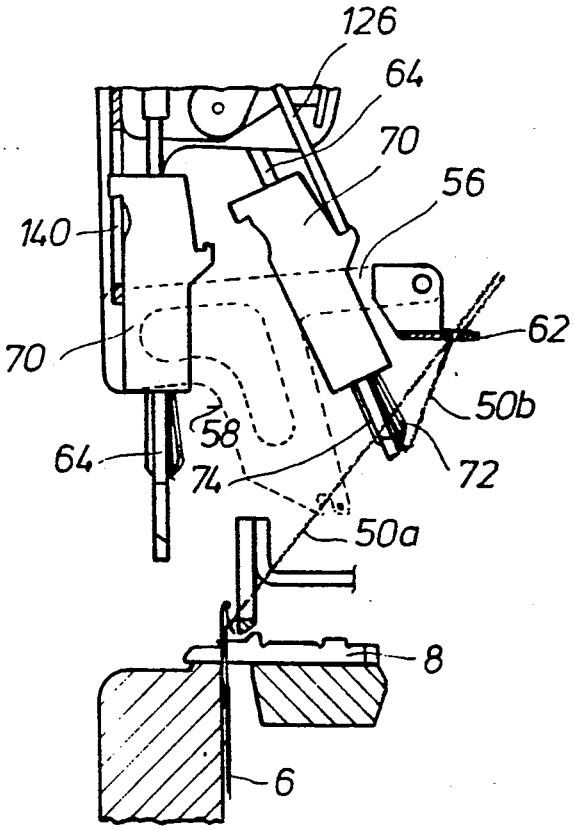

Thereafter (FIG. 13) the opening mechanism operates, whereby the gripper member 72 is raised and the end of yarn 50*a* is released. Subsequently (FIG. 14), the closing mechanism of the yarnguide rod 64 feeding yarn 50*b* operates. On closing, the shears member 74 cuts the yarn 50*b* (whereupon it ceases to be knitted) and grips it, leaving it ready for a new change. Finally (FIG. 15), the yarnguide 64 which had fed yarn 50*a* returns to the position away from the axis of rotation, but in the open position.

The opening and closing movements occur always, but they are effective only if a yarnguide rod 64 has pivoted previously towards its position towards the axis of rotation.

Figure 16:
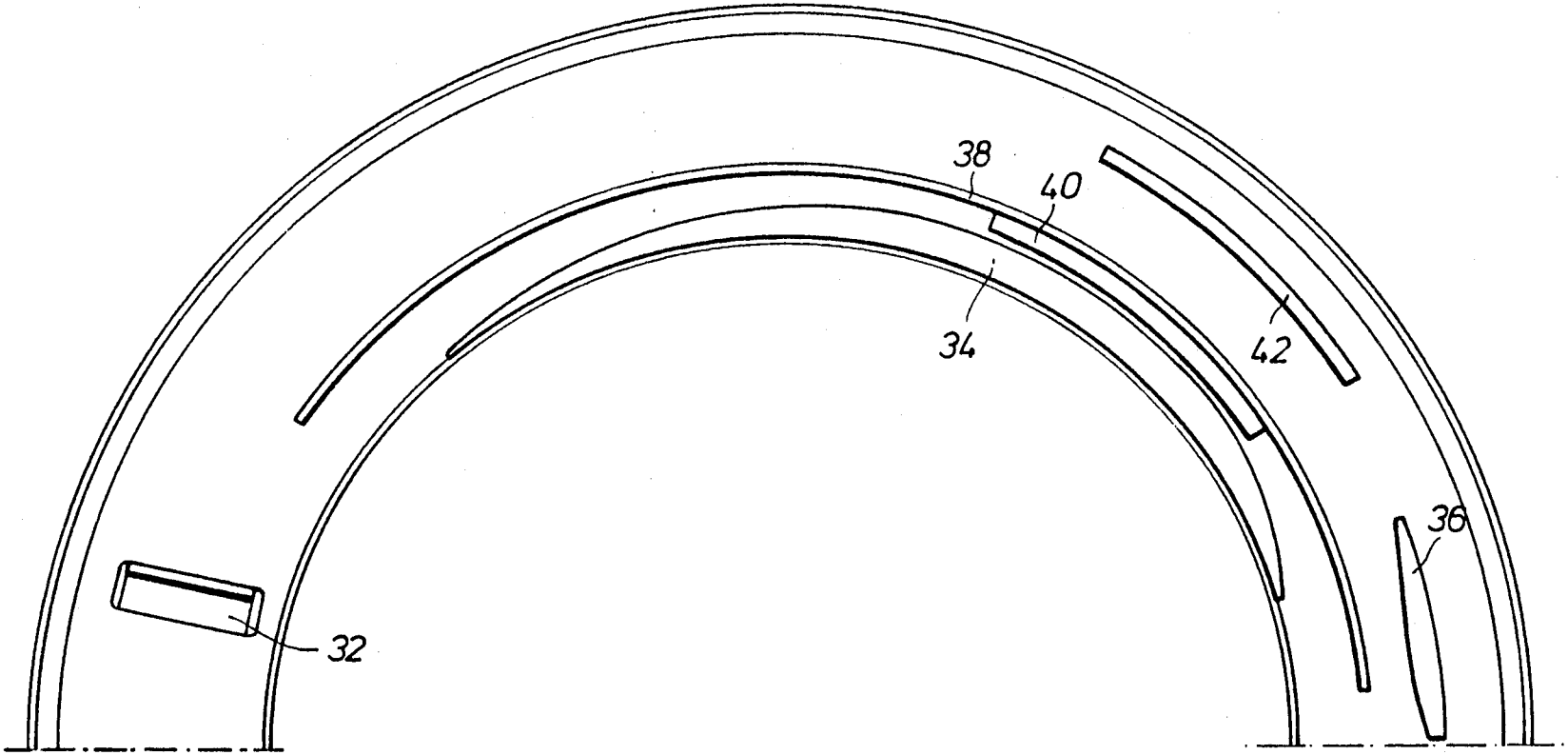
FIG. 16 is a plan view of the radial and axial cams operating on the striper.

As stated above, FIG. 16 shows the axial and radial cams and a selector box 32, which facilitates an understanding of the operation of the system.

It should be observed that with a single control (selection box 32) mounted on the rotating ring 30 containing the said axial and radial cams, the simultaneous engagement with several stripers and with the moving cam 48 is achieved. The box 32 operates, or may operate, once each machine rotation on each striper 2, there being normally 48 stripers of four yarns each.

The selection box 32 receives commands from a controller (not shown) programmed in dependence on the number of yarn changes required to knit the desired garment and said commands arrive synchronously with the machine rotation in the space of time comprised between two consecutive stripers. A conventional synchroniser, not shown, reports the relative position of the box 32 to the stripers to the controller. Although the transmission of commands and programming of the selection box is effected in a period of time substantially shorter that the time available between two consecutive stripers, the mechanical movements ending in the yarn changeover take much longer.

The operations of offering up the incoming yarn 50*a*, picking up of said yarn by the moving cam 48, removal of the outgoing yarn 50*b* and the cutting and retaining of the yarn 50*b* are carried out in a period of time approximately the same as that occupied by half a machine rotation. This relatively long period of time allows the movements of the different parts of the striper 2 to be effected smoothly.

Therefore, assuming a machine having 48 stripers, 24 of them are carrying out the yarn changeover operations almost simultaneously (with a slight phase offset). This peculiarity makes the delivery, gripping and cutting of the yarn extremely reliable, at the same time as it places less mechanical stress on the machine.

The recess 60 of the guide plate 56 is positioned such that it guides the yarn without needing the aid of the yarnguide rod 64. This is particularly inportant when effecting a pattern change, since it is normal in pattern changes to program the pattern change without considering the pattern already being knitted, whereby it is possible to program the operation of a yarnguide rod 64 already in operation.

With the system of the invention, such programming errors do not affect either the pattern it is desired to knit or produce faults in the fabric, since the pivoting of the yarnguide rod takes place without affecting the yarn feed.

INDEX

2 striping mechanism
4 needle cylinder
6 needle
8 sinker
10 cam sections
12 cams
14 cam sections
16 cams
18 support
20 brackets
22 support
24 columns
26 ring
28 bolts
30 rotating ring
32 selector box
34 first radial cam
36 second radial cam
37 intermediate support ring
38 first axial cam
40 second axial cam
42 third axial cam
44 support arm
46 support
48 moving cam
50 yarn
52 common yarnguide
54 rigid covers
56 guide plates
58 inner contour
60 recess
62 infeed yarnguide
64 yarnguide rods
66 notch
68 first spring
70 support member
72 gripper
74 shears
76 tabs
78 window
80 notch edge
82 shears edge
84 fin
86 fin
88 upper transverse surface
90 lower transverse surface
92 lever
94 lever
96 last rocking lever
98 end
100 slide member
102 slot
104 bottom
105 push bottom
106 recess
107 second spring
108 tail portion
110 rear engagement surface
112 upper engagement surface
114 front engagement surface
116 upper butt
118 selectors
120 sloping surface
122 selector head
124 first rocking arm
126 closing lever
128 third spring
130 fourth spring
131 neb
133 swinging arm
134 edge
136 first pusher
138 second rocking arm
140 opening lever
142 window
144 inner active edge
146 fifth spring
148 second pusher
150 contour

What I claim is:

1. In a circular knitting machine comprising an axis of rotation, a needle cylinder provided with needles adapted to receive knitting yarn, cam sections for regulating the movement of said needles, a support for said cam sections, stripers and a common yarnguide from which the yarn may run to the needle, a striping system comprising at least two yarnguide rods, each being provided with a yarn notch, each rod being capable of pivoting between a first position away from said axis of rotation and a second position towards said axis of rotation;

a first spring for each yarnguide rod urging it to said first position;

a support member associated with each yarnguide rod and fixedly attached to a gripper member for retaining the yarn and with a shears member for cutting said yarn, said support member being provided with first means to be pushed downwardly and second means to be pushed upwardly, and being adapted to slide along the rod between a first lower position in which the gripper member retains the yarn and a second upper position in which the gripper member does not retain the yarn, said shears member being adapted to cut the yarn on moving from said second to said first position;

a guide plate for each yarnguide rod, provided with a lower contour in which there is provided a recess for guiding the yarn between the infeed yarnguide and the common yarnguide;

a moving cam, adapted to pick up the yarn retained in a yarnguide rod when the latter is in said second position thereof, such that the yarn slides along said lower contour to reach said recess, be inserted in the common yarnguide and be captured by the needle;

a pivoting mechanism for pivoting each yarnguide rod comprising a last rocking lever having an end;

a selection device for actuating the pivoting mechanisms;

a closing mechanism to lead said support member to said first lower position; and an opening mechanism to lead said support member to said second upper position.

2. The system of claim 1, said selection device comprising:

a slide member for each pivoting mechanism, which is adapted to slide between a retracted position and an extended position, which is housed in a slot and is provided with: a tail portion capable of being depressed into the slot against the urging of a second spring; a rear engagement surface; an upper engagement surface; a front engagement surface; an upper butt and a recess in which there is inserted said end of said last rocking lever with a clearance therebetween, such that a sliding movement of the slide member from said retracted position of a magnitude greater than said clearance, causes said last rocking lever to rock and the actuation of said pivoting mechanism;

a single selection box which, for each slide member, comprises a selector adapted to occupy a retracted inoperative position or an extended operative position in which it engages said upper butt, causing the slide member to slide over a first distance of a magnitude of the order of said clearance;

a first axial cam engaging said upper engagement surfaces of said slide members, causing the depression of said tail portion when the slide members have not moved over said first distance;

a first radial cam engaging said rear engagement surfaces when said tail portions have not been depressed; and a second radial cam engaging said front engagement surfaces to return the slide members to said retracted position.

3. The system of claim 1, wherein said closing mechanism is provided with a first rocking arm pivotably connected to a closing lever which, on the one hand, is adapted to slide between a first retracted position to which it is urged by a third spring and a second, extended position and, on the other hand it is also adapted to pivot between an inoperative position, to which it is urged by a fourth spring, and an operative position to which it is led by the pivoting of any yarnguide rod to the second position thereof towards said axis of rotation, said closing lever having a terminal edge which, when the closing lever has been pivoted to the operative position thereof and is slid towards the extended position thereof, engages said first means of said support member, leading it to the first lower position thereof.

4. The system of claim 3, wherein said first rocking arm of said closing mechanism is engaged by a first pusher which in turn is engaged by a second axial cam, whereby the said closing lever is slid to the extended position thereof.

5. The system of claim 1, wherein said opening mechanism be provided with a second rocking arm pivotably attached to an opening lever which is adapted to slide between a low position to which it is urged by a fifth spring and a high position, said opening lever having an inner operative edge which, when the lever slides from said low position to said high position, is adapted to engage said second means of said support member, when the yarnguide rod corresponding to the support member is in the second position thereof towards the axis of rotation.

6. The system of claim 5, wherein said second rocking arm of said opening mechanism is engaged by a second pusher which in turn is engaged by a third axial cam, whereby said opening lever is slid to the high position thereof.

* * * * *